US005346590A

United States Patent [19]

Jaala

[11] Patent Number: 5,346,590

[45] Date of Patent: Sep. 13, 1994

[54] DRYER SCREEN IN A PAPER MACHINE

[75] Inventor: Erkki Jaala, Tampere, Finland

[73] Assignee: Tamfelt Oy Ab, Tampere, Finland

[21] Appl. No.: 10,693

[22] Filed: Jan. 29, 1993

[30] Foreign Application Priority Data

Feb. 24, 1992 [FI] Finland ..... 920809

[51] Int. Cl.[5] ..... D03D 11/00

[52] U.S. Cl. ..... 162/232; 162/902; 139/383 A

[58] Field of Search ..... 428/213; 139/383 A; 162/902, 232

[56] References Cited

U.S. PATENT DOCUMENTS

| | | | |
|---|---|---|---|
| 2,288,649 | 1/1939 | Robie . | |
| 3,885,603 | 5/1975 | Slaughter | 139/383 A |
| 3,900,659 | 8/1975 | MacBean | 162/348 |
| 4,467,839 | 8/1984 | Westhead | 139/383 A |
| 4,515,853 | 5/1985 | Borel | 139/383 A |
| 4,554,953 | 11/1985 | Borel | 139/383 A |
| 4,759,976 | 7/1988 | Dutt | 139/383 A |
| 4,815,499 | 3/1989 | Johnson | 139/383 A |
| 4,974,642 | 12/1990 | Taipale | 139/383 A |
| 5,013,330 | 5/1991 | Durkin et al. | 139/383 A |
| 5,066,532 | 11/1991 | Gaisser | 162/902 |
| 5,151,316 | 9/1992 | Durkin | 139/383 A |

FOREIGN PATENT DOCUMENTS

| | | |
|---|---|---|
| 0116945 | 8/1984 | European Pat. Off. . |
| 793140 | 10/1979 | Finland . |
| 81858 | 11/1985 | Finland . |
| 70947 | 7/1986 | Finland . |
| 871230 | 3/1987 | Finland . |
| 783268 | 11/1987 | Finland . |
| 893301 | 7/1988 | Finland . |
| 81858 | 8/1990 | Finland . |
| 8805841 | 8/1988 | PCT Int'l Appl. . |

*Primary Examiner*—W. Gary Jones
*Assistant Examiner*—Brenda Adele Lamb
*Attorney, Agent, or Firm*—Lowe, Price, LeBlanc & Becker

[57] ABSTRACT

A dryer screen in a paper machine has two superimposed connected gauze structures. It has a surface gauze layer an a bottom gauze layer, each having respective weft threads (1, 3) and warp threads (2, 4). In the dryer screen, the warp threads (2, 4) are similar in both the surface and bottom gauze layers, and they are similar in cross-section. The warp threads (4) of the bottom gauze layer pass at suitable intervals over the weft threads (1) of the surface gauze layer to bond the bottom and surface gauze layer together. The cross-sectional area and shape of the weft threads of the bottom gauze are selected so that the respective actual lengths of the warp threads (2, 4) of the surface gauze layer are equal to the corresponding threads of the bottom gauze layer.

10 Claims, 2 Drawing Sheets

FIG. 2a
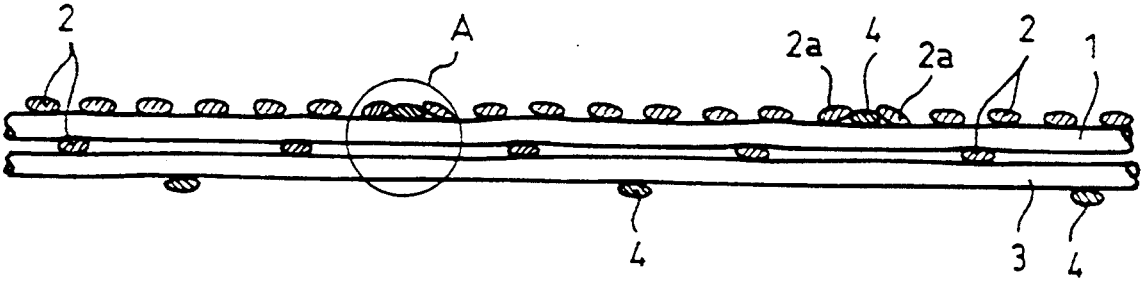
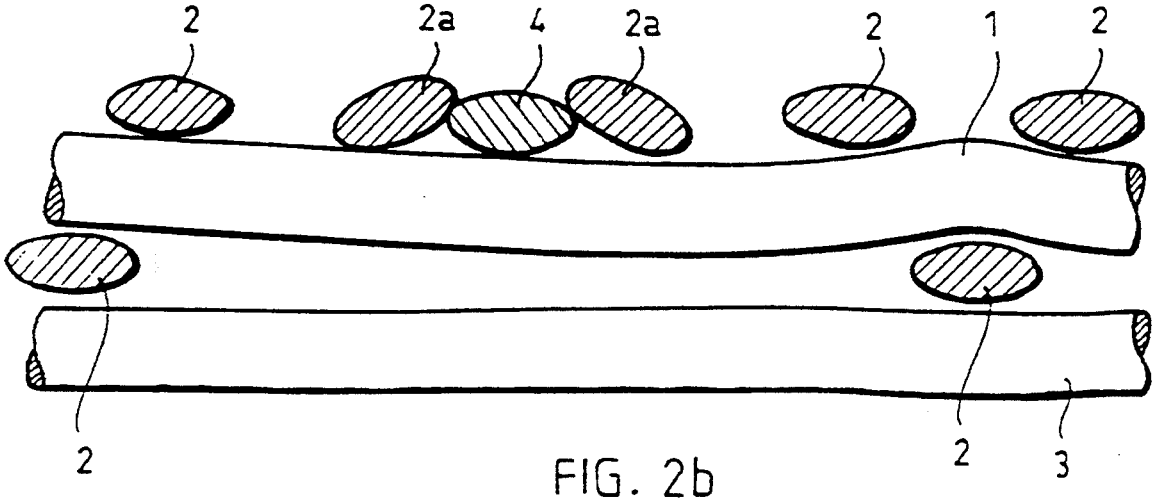
FIG. 2b
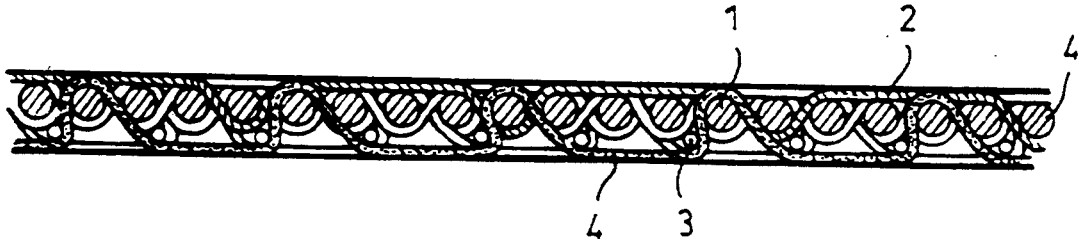
FIG. 3

DRYER SCREEN IN A PAPER MACHINE

The invention relates to a dryer screen in a paper machine, the dryer screen comprising two gauze layers each having weft threads and warp threads, the gauze layers being bonded together during weaving so that the warp threads of the surface gauze are interwoven only with the weft threads of the surface gauze, and the bottom gauze and the surface gauze are bonded together by passing the warp threads of the bottom gauze at suitable intervals over the weft threads of the surface gauze along the weft thread side facing the surface of the dryer screen.

BACKGROUND OF THE PRIOR ART

Dryer screens in paper machines are used to pass a paper web to be dried through the drying section and support it so that there are as few wire-marks in the finished fibre web as possible, while the permeability and behaviour of the screen within the drying section are such as desired. One typically aims to provide the dryer screen with a surface structure having the greatest possible evenness and woven as closely as possible, which is described by a percentage value called warp fill. In practice, a 100% warp fill is aimed at, though even higher values are theoretically possible. Due to the location of dryer screens, they are subject to varying conditions, being thus exposed to both hot and wet conditions and hot and dry conditions. To operate properly, the dryer screen must have a good dimensional stability and resistance to longitudinal strains in the above-mentioned conditions as well as flexibility. Various warp threads and weave patterns have been used in the manufacture of dryer screen structures. For instance, flat warp threads have been used to achieve desired dryer screen structures. One such structure is disclosed in FI Patent Application 783268.

FI Patent 81858, in turn, discloses a dryer screen comprising two superimposed gauze structures bonded together. The bottom gauze consists of a stiffer, more robust monofilament thread while the surface layer consists of hollow fibres or softer fibres treated with various foam particles. The surface layer and the bottom layer are bonded together by interweaving the weft threads of the bottom layer and the warp threads of the surface layer. A drawback of this structure is that when the hard round weft threads of the bottom layer and the hard round warp threads passing over them are interwoven into the soft surface layer, unevennesses will occur and possibly also wiremarks as the structure of the bottom gauze is stiffer and harder than that of the surface gauze.

In wet screens intended for a different purpose, a high water permeability is required for removing water from the fibre suspension. In such wires, double gauze structures have also been used in which the upper and lower gauze layer are interconnected by passing different warp threads from one layer to the other. A drawback of such structures is that when threads are passed from one layer to the other, problems are usually caused in weaving and wiremarks will occur as such threads disturb the weaving of the other layer. Such structures are disclosed e.g. in FI Patent Application 871230, FI Patent Application 793140, EP Patent Application 116945 and FI Patent Application 893301. To avoid the problems associated with these structures, FI Published Specification 70947 suggests a paper machine wet screen in which the surface gauze and the bottom gauze are bonded together by separate bonding weft threads passing in the transverse direction of the wire, the warp threads of both gauze layers passing around the bonding threads at suitable intervals. Although this structure is operative as such, it is difficult to weave and requires that the feed amount of warp threads can be adjusted in weaving each layer, which requires a complicated weaving machine. Nor can wet screen structures be used as such in dryer screens as their use and desired properties are very different and even opposite in many respects. Accordingly, it is not self-evident that the wet screen structures are applicable as such nor have there been any attempts to use them in the manufacture of dryer screens.

SUMMARY OF THE DISCLOSURE

The object of the present invention is to provide a paper machine dryer screen in which a double gauze structure can be used without the disadvantages of the prior art techniques and which is easy to weave even with a simple weaving machine.

The dryer screen according to the invention is characterized in that all warp threads in the dryer screen are substantially similar and flat in cross-section, and that the cross-sectional area and shape of the weft threads of the bottom gauze are selected so that the respective actual lengths of the warp threads of the surface gauze layer and that of the bottom gauze layer are substantially equal per a length unit of the dryer screen.

The basic idea of the invention is that the warp threads of both the surface gauze and the bottom gauze are similar and flattish in shape, preferably elliptical, so that they can be interwoven properly without the problem that the passing of the warp thread of the bottom gauze over the weft thread of the surface gauze causes visible or measurable variation in the evenness and closeness of threads of the surface gauze. In another aspect of the invention it is provided that the cross-sectional area and shape of the weft threads of the bottom gauze are dimensioned so that the respective lengths of the warp threads of the surface gauze and that of the bottom gauze are substantially equal per unit length of the dryer screen, and so the warp threads can be fed during weaving from the same warp beam. No double warp beams and associated control means are required.

An advantage of the gauze according to the invention is that an even surface gauze of suitable air permeability, where the bond between the surface gauze and the bottom gauze is not visible, is obtained simply and easily. In addition, to form a seam in the screen, the bottom gauze can be easily unravelled in a required amount without visibly or significantly affecting the structure of the surface gauze within the seam area.

Another advantage of the screen structure according to the invention is that the surface gauze and the bottom gauze can be woven or assembled in several different ways, so that the structure of the surface gauze can be designed optimally for the requirements of each application and the quality of the web to be produced, and the bottom gauze can be correspondingly designed in various ways without affecting the properties of the screen. It is also possible to shape and produce the bottom gauze so that the weft threads and the warp threads do not form together a complete gauze which would hold together without the surface gauze, so that the bottom gauze can be removed simply and easily when forming the seam.

BRIEF DESCRIPTION OF THE DRAWING

The invention will be described more closely with reference to the attached drawings, in which

FIGS. 2*a* and 2*b* are schematic sectional views of the dryer screen shown in FIG. 1 in the weft direction; and FIG. 3 is a sectional view of another dryer screen according to the invention in the weft direction.

DETAILED DESCRIPTION OF THE PREFERRED EMBODIMENTS

Figures 1A, 1B, 1C:
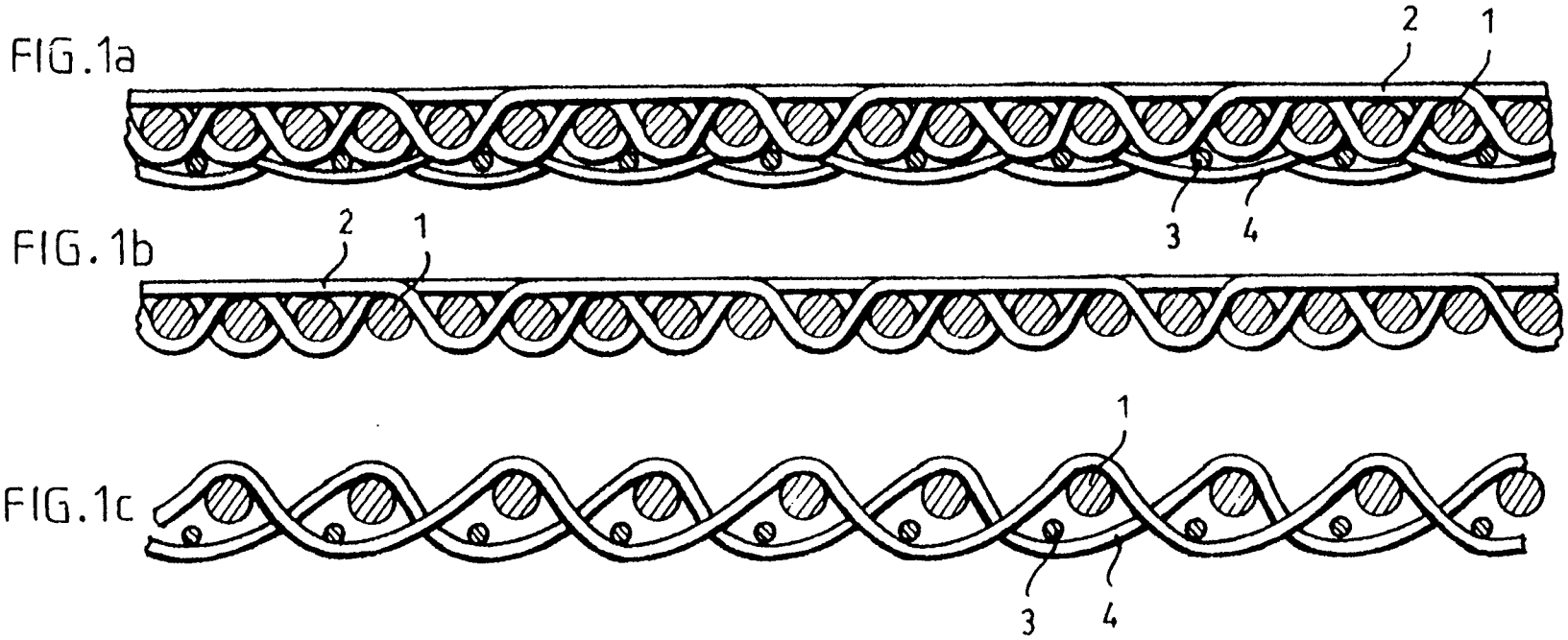
FIGS. 1*a* to 1*c* are schematic sectional views of a preferred embodiment of a dryer screen according to the invention in the warp direction.

FIG. 1*a* shows the structure of the dryer screen according to the invention, in which weft threads 1 and warp threads 2 of the surface gauze are woven into a surface layer as even and as closely spaced as possible. Depending on the desired surface structure of the screen, different shaft-bindings can be used. FIG. 1*a* further shows how weft threads 3 and warp threads 4 of the bottom gauze are woven to bond together the surface gauze and the bottom gauze. As appears from FIG. 1*a*, the weft threads 3 of the bottom gauze are positioned in the gauze in line with the interspaces between the adjacent weft threads 1 of the surface gauze, so that they will not form any structural protuberances relative to the weft threads of the surface gauze.

FIG. 1*b* shows the structure of the surface gauze. It appears that the weft threads 1 of the surface gauze and the warp threads of the surface gauze are interwoven so as to form a substantially even surface woven as closely as possible. The structure of the bottom gauze is different.

FIG. 1*c* shows how the bottom gauze is woven: the warp threads 4 of the bottom gauze pass around both the weft threads 1 of the surface gauze and the weft threads 3 of the bottom gauze while the weft threads 1 and 3 are positioned side by side, as shown in FIG. 1*a*. The warp threads 2 and 4 of the dryer screen are preferably similar in cross-section, preferably oval or elliptical, so that they fit together within the gauze as well as possible when interwoven. The cross-section and dimensions of the weft threads of the bottom gauze are selected such that the warp thread demand of the surface gauze and that of the bottom gauze are substantially equal. The term "demand" means the respective lengths of the warp threads per unit length of the dryer screen. These are equal for both the upper and the lower gauze.

By selecting the cross-section of the weft thread of the bottom gauze so that it deviates slightly from the theoretically most suitable cross-section, a desired small tightness difference is obtained between the bottom gauze and the surface gauze, which ensures a proper end result. This, however, does not require another warp beam but can be accomplished merely by selecting the diameter of the weft thread 3 of the bottom gauze appropriately. As the surface gauze and the bottom gauze are also different in the sense that the surface gauze is woven more closely, and its weft threads 1 are more closely located than the weft threads 3 of the bottom gauze, the number of the weft threads in the bottom gauze is preferably selected so that both the weft thread 1 of the surface gauze used for bonding together the surface gauze and the bottom gauze and the weft thread 3 of the bottom gauze will be within the loops of the warp threads 4 of the bottom gauze. Accordingly, each loop of the bottom gauze preferably passes around both the bonding weft thread of the surface gauze and the weft thread of the bottom gauze. They will be positioned side by side as shown in FIGS. 1*a* and 1*c* due to the fact that the gauze does not force them into alignment with each other as they are not bonded together by crossing warp threads. In this way an even strainless gauze is obtained which spreads out naturally.

FIG. 2*a* is a schematic sectional view of the dryer screen according to the invention in the weft direction. The figure shows by way of example how the weft threads/warp threads of the surface layer and the bottom layer are positioned with respect to each other. FIG. 2*a* shows the weft thread 1 of the surface layer and the weft thread 3 of the bottom layer below it. Similarly as in the cases shown in FIGS. 1*a* to 1*c*, the gauze of FIG. 2*a* is a five-shaft binding in which the surface gauze is rather closely woven as the warp threads 2 are positioned close to each other on the visible surface facing the web, and each warp thread passes under every fifth weft thread 1 only. FIG. 2*a* also shows how the warp threads 4 of the bottom gauze intermittently pass over the weft thread 1 of the surface gauze, being thus positioned in line with an interspace between the warp threads 2*a* of the surface gauze below the warp threads.

FIG. 2*b* is an enlarged schematic view of the point indicated with the circle A in FIG. 2*a*, showing more clearly how the warp thread 4 of the bottom gauze is positioned with respect to the warp threads 2*a* of the surface gauze. The warp threads 2 of the surface gauze pass on both sides of the weft thread 1 of the surface gauze in accordance with the selected weave pattern; it, however, always remains on the same side of the weft thread of the bottom gauze so that the weft thread 3 of the bottom gauze will not be bonded to the surface gauze in any way. The warp thread 4 of the bottom gauze passes over the weft thread 1 of the surface gauze at selected intervals, thus bonding the bottom gauze and the surface gauze together. The warp thread 4 of the bottom gauze will then be positioned between the warp threads 2*a* of the surface gauze, causing the weft thread 1 of the surface gauze to be pressed towards the bottom gauze to a greater extent than normally and the warp threads 2*a* of the surface gauze to be positioned slightly obliquely on both sides of the warp thread 4 of the bottom gauze. However, there is no clearly noticeable change in the evenness of the surface gauze in the structure so obtained, especially when the warp threads 2 and 4 are oval or elliptical in shape. With other flattish thread shapes, the effect of the warp threads 4 of the bottom gauze on the evenness of the surface gauze is also nearly nonexistent, and so the gauzes will be bonded together appropriately. For instance, when it is necessary to form a seam in the screen, the bottom gauze can be unravelled at the end of the screen over a desired length so that the surface gauze can be folded double for forming the seam. This, however, does not essentially affect the evenness of the surface gauze within the seam area, so that the surface of the dryer screen will be uniform with the exception of the area immediately around the seam. The embodiment of the invention shown in FIGS. 1*a* to 1*c* and 2*a* to 2*b* is advantageous in that both the surface gauze and the bottom gauze comprise a single layer of weft threads so that the dryer screen will be thin and contains little air without having to sacrifice other advantageous screen properties.

FIG. 3 is a sectional view of another embodiment of the dryer screen according to the invention in the weft direction. In this embodiment, the gauze of the surface layer is, e.g., similar to that shown in the embodiment of FIGS. 2*a* and 2*b*. The bottom gauze, however, is different. In this embodiment the bottom gauze does not alone, i.e. without the surface gauze, form a complete gauze but if the surface gauze is removed, only crossing weft threads 3 and warp threads 4 will remain. As appears from FIG. 3, the warp thread passes over the weft thread 1 of the surface layer and then again under the weft thread 3 of the bottom layer, so that the weft thread 3 remains in an interspace between two adjacent weft threads 1 of the surface layer and is pressed by the warp threads 4 of the bottom layer against the warp threads 2 of the surface layer. All warp threads in the bottom gauze pass in the same way as the topmost warp thread 4 in FIG. 3, so that adjacent warp threads do not form a loop around the weft thread 3 so that they are not at all interwoven with each other.

The invention has been described above and in the attached drawings only by way of example, and it is in no way restricted to this example. In the invention, it is essential that the warp threads of the surface gauze and the bottom gauze are substantially equal in shape and similar, and that the thickness of the weft threads of the bottom gauze is selected so that the warp respective actual lengths of the warp threads of the surface gauze is substantially equal to that of the bottom gauze for each unit length of the dryer screen. Therefore the dryer screen according to the invention is easy to manufacture by simple weaving machines. The cross-section of the warp thread may be flat in different ways, such as oval or elliptical, so that the final product will have the desired evenness and fill. The cross-section of the weft threads may be e.g. round or flat. On weaving the bottom gauze, the size and shape of the weft thread should be such that the actual lengths of the warp threads are substantially equal in the surface gauze and in the bottom gauze per unit length of the dryer screen. The bonding structures between the surface gauze and the bottom gauze and the density and different shaft bindings of the surface gauze can be selected according to the desired surface properties of the dryer screen whereas they do not otherwise affect the operation or applicability of the invention.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

I claim:

1. A dryer screen for a dryer section of a paper-making machine, comprising:

a bottom gauze layer and a top gauze layer, each having respective weft threads and warp threads, the gauze layers being bonded together during weaving so that the warp threads of the surface gauze layer are interwoven only with the weft threads of the surface gauze layer, and the bottom and surface gauze layers are bonded together by passing of the warp threads of the bottom gauze layer at suitable intervals over the weft threads of the surface gauze layer along a weft thread side facing a surface of the dryer screen, all warp threads in the dryer screen being substantially similar in cross-section, and the cross-sectional area and shape of the weft threads of the bottom gauze layer being selected so that the respective actual lengths of the warp threads of the surface gauze layer and the warp threads of the bottom gauze layer are substantially equal per a length unit of the dryer screen.

2. The dryer screen according to claim 1, wherein:

the cross-section of the warp threads is oval or elliptical.

3. The dryer screen according to claim 1, wherein:

the weft threads of the bottom gauze layer are positioned in a common interspace, between the warp threads in the bottom gauze layer with the weft threads of the surface gauze layer over which the warp threads of the bottom gauze layer are passed to bond the surface gauze and the bottom gauze layer together.

4. The dryer screen according to claim 1, wherein:

when forming the bottom gauze layer, the weft threads of the bottom gauze layer remain between all warp threads of the bottom gauze layer and the warp threads of the surface gauze layer so that the weft threads and the warp threads of the bottom gauze layer hold together with the surface gauze layer.

5. The dryer screen according to claim 1, wherein:

the surface gauze layer of the screen comprises weft threads disposed in a single layer and warp threads woven therewith into a gauze, and the warp threads of the bottom layer are passed between the weft and warp threads of the surface layer to bond the surface and bottom gauze layers together.

6. The dryer screen according to claim 5, wherein:

the warp threads of the bottom gauze layer are arranged to pass in line with interspaces between two adjacent warp threads of the surface gauze layer.

7. The dryer screen according to claim 1, wherein:

the bottom gauze comprises weft threads arranged in a single layer.

8. The dryer screen according to claim 2, wherein:

the surface gauze layer of the screen comprises weft threads arranged in a single layer and warp threads woven therewith into a gauze, and the warp threads of the bottom gauze layer are passed between the weft and warp threads of the surface gauze layer to bond the surface and bottom gauze layers together.

9. The dryer screen according to claim 8, wherein:

the warp threads of the bottom gauze layer are arranged to pass in line with interspaces between two adjacent warp threads of the surface gauze layer.

10. The dryer screen according to claim 2, wherein:

the weft threads of the bottom gauze layer are positioned in a common interspace between the warp threads of the bottom gauze layer with the weft threads of the surface gauze layer over which the warp threads of the bottom gauze layer are passed to bond the surface and bottom gauze layers together.

* * * * *